US005677699A

United States Patent [19]

Strickland

[11] Patent Number: 5,677,699

[45] Date of Patent: Oct. 14, 1997

[54] HELICAL MICROSTRIP ANTENNA WITH IMPEDANCE TAPER

[75] Inventor: Peter C. Strickland, Ottawa, Canada

[73] Assignee: Cal Corporation, Ottawa, Canada

[21] Appl. No.: 458,252

[22] Filed: Jun. 2, 1995

[30] Foreign Application Priority Data

Nov. 29, 1994 [CA] Canada ..... 2136920

[51] Int. Cl.[6] ..... H01Q 1/36; H01Q 11/08

[52] U.S. Cl. ..... 343/895; 343/846

[58] Field of Search ..... 343/895, 846; H01Q 1/36, 11/08

[56] References Cited

U.S. PATENT DOCUMENTS 2,919,442 12/1959 Nussbaum ..... 343/895

2,945,227 7/1960 Broussaud ..... 343/895

3,263,233 7/1966 Spitz ..... 343/895

3,633,210 1/1972 Westerman et al. ..... 343/895

*Primary Examiner*—Michael C. Wimer

*Attorney, Agent, or Firm*—Pascal & Associates

[57] ABSTRACT

A helical antenna comprised of a helical conductor having one end adapted to be connected to a feedline, a conductive surface contained within but spaced from the helical conductor, the distance of the conductive surface from the helical conductor being predetermined so as to vary the radiation loss from the helical conductor during electromagnetic emission therefrom.

18 Claims, 1 Drawing Sheet

HELICAL MICROSTRIP ANTENNA WITH IMPEDANCE TAPER

FIELD OF THE INVENTION

This invention relates to the field of antennas, and in particular to helical antennas.

BACKGROUND TO THE INVENTION

A conventional helical antenna which has a radiating conductor length which is longer than several wavelengths of a signal it is to radiate suffers from the problem of rapid decay of current density along its helical conductor (radiator). As a result, there is less emission from points on the helical conductor progressively distant from its feed end, and the gain of the antenna is lower than that which could be achieved if the current density was constant along the length of the conductor.

Techniques have been used to decrease the rate of decay of the current density along the antenna, such as end loading of the helical radiator, varying the pitch of the helical conductor helix, etc. However these techniques provide only minor improvement in the current density profile.

SUMMARY OF THE INVENTION

The present invention provides a simple and inexpensive means for controlling the radiation loss over the length of the helical antenna, and provides means for creating an antenna with uniform current density along the helical conductor, or with varying current density with length and/or with peripheral direction along the antenna.

In accordance with the present invention, an internal conductive surface is placed within the helix, which varies in distance from the helical conductor. For example, with a helical conductor (radiator) supported on a cylindrical dielectric tube or by other means, a truncated conical conductive surface located coaxially within the tube can result in uniform current density along the antenna, and thus maximum radiation efficiency of the helical antenna.

The crossection of either or both of the helical conductor winding and of the conductor surface can be circular or some other crossection in order to control the current density at any point of the helical conductor, which can vary the direction and/or directivity of radiation of the antenna. Indeed, by mechanically varying either of these crossections or the distance of the conductor surface from the helical conductor at any point, the direction of radiation and/or directivity of the antenna can be controlled.

In accordance with an embodiment of the invention, a helical antenna is comprised of a helical conductor having one end adapted to be connected to a feedline, and a conductive surface contained within but spaced from the helical conductor, the distance of the conductive surface from the helical conductor being predetermined so as to vary the radiation loss from the helical conductor during electromagnetic emission therefrom.

In accordance with another embodiment of the invention, a helical antenna is comprised of a helical conductor wound in the shape of a circular crossection cylinder, a conductive surface in the shape of a truncated cone contained within the cylinder shaped helical conductor and spaced from the helical conductor, the mutual spacing thereof increasing from a first to a second end, a ground plane disposed orthogonally to the axis of the helical conductor adjacent the first end, and apparatus for connecting a feedline to one end of the helical conductor.

BRIEF INTRODUCTION TO THE DRAWINGS

A better understanding of the invention will be obtained by reading the description of the invention below, with reference to the following drawings, in which.

DETAILED DESCRIPTION OF THE INVENTION

Figure 1:
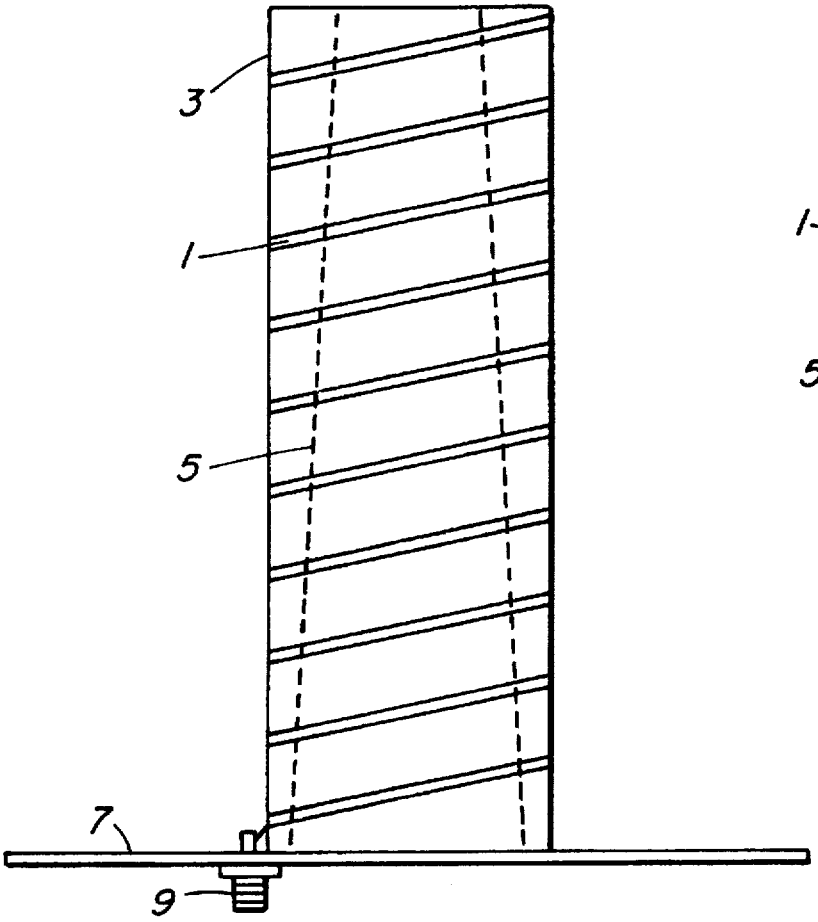
FIG. 1 is a crossection of an embodiment of the invention.
Figure 1A:
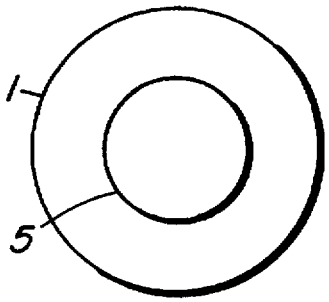
FIG. 1A is a top view of the antenna shown in FIG. 1.

In accordance with an embodiment of the invention, a helical conductor 1, which may be in the form of a conductive strip, is supported on a cylindrical dielectric tube 3. However the conductor may be supported by any other means, for example insulating arms or ribs protruding from the ground plane. In the embodiment shown, the support tube has circular crossection. The helical conductor thus is wound in a circular cylindrical shape.

A conductive surface 5 is located spaced from the conductor internally of the helical conductor helix. In the embodiment shown the shape of the conductive surface is a truncated cone. The bottom end of the antenna as shown is a feed end for receiving feed current for radiation of a signal from the antenna.

A ground plane 7 is located with its plane perpendicular to the axis of the helical conductor. It is preferred that the helical conductor support should be fixed to the ground plane, so as to fix the position of the helical conductor relative to the ground plane. The end of the helical conductor, designated the feed end, is connected to a feed connector 9 which is passed through the ground plane.

The internal conductive surface may be connected to the ground plane.

As a result of the relative nearness of the conductive surface to the helical conductor adjacent its feed end, the radiation loss at that location is a minimum. As the distance of the conductive surface from the helical conductor increases, the radiation loss from the helical conductor increases. Thus with the linear variation of the conductive surface from the helical conductor in the right circular cylinder shape shown, the normal linear decrease in radiation loss from the helical conductor with distance from the feed which would otherwise exist is compensated, resulting in equal or near equal radiation contribution from the entire helical conductor over its entire length.

It will be recognized that there may be cases in which it is undesirable to have equal radiation over the entire length of the helical conductor. For example where there may be an external shielding structure which would interfere with a side portion of the radiation lobe of the antenna, it might be desirable to skew the radiation lobe away from the shielding structure. There may be situations in which it is only possible to use a helical antenna and yet directionality may be desired which is different from that otherwise possible from the position of the helical antenna. Embodiments of the present invention make it possible to skew or otherwise control the directionality of the antenna.

For example, the distance of the internal conductive surface 5 can vary from the helical conductor. This can be effected by axial offsetting and/or rotating the axis of the internal conductive surface relative to the axis of the helical conductor.

Figure 2:
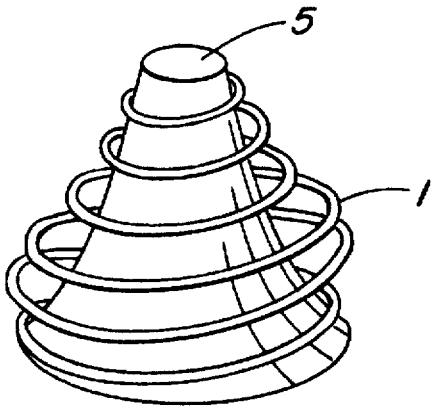
FIG. 2 is a schematic perspective view of another embodiment to the invention.

Other or additional ways of varying the distance of the internal conductive surface can be to form the internal surface into a different shape than the truncated cone shown, or to form the helical conductor into a shape other than circularly cylindrical, or both of the above, with or without offsetting and/or rotating their mutual axes, for example as shown schematically in FIG. 2.

Where the conductive surface is close to the helical conductor, radiation loss is reduced, and where it is distant from the helical conductor it is increased. By predetermining this distance, the radiation loss from different parts of the helical conductor, and thus the shape of the radiation lobe from the antenna can be controlled.

Indeed, the distance of the internal conductor can be dynamically controlled, e.g. by a mechanical system controlled by a switchable relays or motors. For example if the internal conductor is flexible, hinged or otherwise moveable, an arm controlled from a motor or relay can move the internal conductor nearer or farther from the helical conductor, allowing dynamic control and changing of the radiation loss and thus the shape of the radiation lobe from the antenna, from a remote location. As another example, the internal helical conductor can be a flexible conductive sheet having one edge fixed and the other edge wound on a central axle, can be wound and unwound from the central axle, changing the distance of the entire internal conductor from the helical conductor, thus varying the length to gain ratio of the antenna or different parts thereof.

The invention can be uefully implemented as a helical microstrip antenna, e.g. for L-Band satellite communications (1525–1660.5 MHz). It can be used in fixed and/or portable installations.

A person understanding this invention may now conceive of alternative structures and embodiments or variations of the above. All of those which fall within the scope of the claims appended hereto are considered to be part of the present invention.

I claim:

1. A helical antenna comprising a helical conductor having one end adapted to be connected to a feedline, a conductive electromagnetically reflecting surface contained within but spaced from the helical conductor, the spacing being closest adjacent said one end of the helical conductor, the distance of the helical conductor from the conductive surface along the axis of the helical conductor varying so as to vary the radiation loss from the helical conductor along its axis during electromagnetic emission therefrom, said one end being located adjacent an outwardly tapered end of one of the helical conductor and the conductive surface, and a ground plane substantially orthogonal to the axis of the helical conductor located adjacent said one end of the helical conductor, connected to said conductive surface.

2. A helical antenna as defined in claim 1 in which the conductive surface has a circular cross-section.

3. A helical antenna as defined in claim 1 in which the conductive surface has a non-circular cross-section.

4. A helical antenna as defined in claim 2 in which the central axis of the conductive surface and of the helical conductor are coincident.

5. A helical antenna as defined in claim 2 in which the central axis of the conductive surface and of the helical conductor are not coincident.

6. A helical antenna as defined in claim 3 in which the central axis of the conductive surface and of the helical conductor are coincident.

7. A helical antenna as defined in claim 3 in which the central axis of the conductive surface and of the helical conductor are not coincident.

8. A helical antenna as defined in claim 1 in which the helical conductor is wound in the shape of a cylinder.

9. A helical antenna as defined in claim 8 in which the internal conductor is conical in shape.

10. A helical antenna as defined in claim 8 in which the cylinder has a diameter which is not constant from one end thereof to the other.

11. A helical antenna as defined in claim 1 wherein said helical conductor is wound in the shape of a circular cylinder, said conductive electromagnetically reflecting surface being in the shape of a truncated cone contained within the cylinder shaped helical conductor and spaced from the helical conductor, the mutual spacing thereof increasing from said one end to a second end, and means for connecting a feedline to said one end of the helical conductor.

12. A helical antenna as defined in claim 11 in which the helical conductor is wound on a dielectric support tube, one end of the dielectric support tube being fixed to the ground plane, said one end of the helical conductor being adjacent the ground plane and an insulative feed connector fixed to and passing through the ground plane and connected to said one end of the helical conductor.

13. A helical antenna as defined in claim 11 in which the axes of the helical conductor and of the ground plane are coincident.

14. A helical antenna as defined in claim 11 in which the axes of the helical conductor and of the ground plane are not coincident.

15. A helical antenna as defined in claim 11 in which the conducting surface is non-linear.

16. A helical antenna as defined in claim 11 in which the conducting surface is linear.

17. A helical antenna as defined in claim 11 in which the axes of the helical conductor and the center of the ground plane are coincident.

18. A helical antenna as defined in claim 11 in which the axes of the helical conductor and the center of the ground plane are not coincident.

* * * * *